US008740349B2

(12) United States Patent
Takano et al.

(10) Patent No.: US 8,740,349 B2
(45) Date of Patent: Jun. 3, 2014

(54) IMAGE FORMING APPARATUS

(75) Inventors: Kuniyori Takano, Kanagawa (JP); Honriku Jo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/328,074

(22) Filed: Dec. 16, 2011

(65) Prior Publication Data

US 2012/0162315 A1 Jun. 28, 2012

(30) Foreign Application Priority Data

Dec. 28, 2010 (JP) ..... 2010-292132

(51) Int. Cl.
*B41J 23/00* (2006.01)

(52) U.S. Cl.
USPC ..... 347/37

(58) Field of Classification Search
CPC ..... B41J 13/08; B41J 15/04; B41J 15/02; B41J 11/007
USPC ..... 347/35, 37, 104
See application file for complete search history.

(56) References Cited

U.S. PATENT DOCUMENTS

| | | | | |
|---|---|---|---|---|
| 2,202,496 | A * | 5/1940 | La Bombard | 493/334 |
| 6,340,220 | B1 * | 1/2002 | Gaylor et al. | 347/35 |
| 6,386,697 | B1 * | 5/2002 | Yamamoto et al. | 347/103 |
| 6,619,783 | B2 | 9/2003 | Kanaya et al. | |
| 6,692,100 | B2 * | 2/2004 | Steinfield et al. | 347/22 |
| 6,957,881 | B2 * | 10/2005 | Nishino | 347/33 |
| 7,073,886 | B2 * | 7/2006 | Nakamura | 347/33 |
| 7,219,976 | B2 * | 5/2007 | Mori et al. | 347/33 |
| 7,364,260 | B2 * | 4/2008 | Kojima | 347/33 |
| 7,448,745 | B2 * | 11/2008 | Kibayashi | 347/104 |
| 7,562,961 | B2 * | 7/2009 | Inoue | 347/35 |
| 7,815,302 | B2 * | 10/2010 | Kersey et al. | 347/101 |
| 7,850,276 | B2 * | 12/2010 | Lugaresi et al. | 347/29 |
| 7,967,405 | B2 * | 6/2011 | Martinez, Jr. | 347/2 |
| 8,038,258 | B2 * | 10/2011 | Ray et al. | 347/37 |
| 2005/0162461 | A1 * | 7/2005 | Fujimori et al. | 347/33 |
| 2007/0070116 | A1 * | 3/2007 | Kojima | 347/33 |
| 2007/0132799 | A1 * | 6/2007 | Ilda | 347/16 |
| 2008/0266342 | A1 * | 10/2008 | Steinfield et al. | 347/14 |
| 2009/0122107 | A1 * | 5/2009 | Ray et al. | 347/37 |
| 2009/0244130 | A1 * | 10/2009 | Mitsuhashi et al. | 347/9 |
| 2009/0309918 | A1 * | 12/2009 | Yoshida et al. | 347/30 |
| 2010/0214355 | A1 * | 8/2010 | Inoue | 347/28 |
| 2010/0238234 | A1 * | 9/2010 | Inoue | 347/33 |
| 2010/0315463 | A1 * | 12/2010 | Escude et al. | 347/33 |
| 2011/0234696 | A1 * | 9/2011 | Inoue | 347/33 |

FOREIGN PATENT DOCUMENTS

| | | |
|---|---|---|
| JP | 2000-153621 | 6/2000 |
| JP | 2009-220365 | 10/2009 |

* cited by examiner

*Primary Examiner* — Matthew Luu
*Assistant Examiner* — Patrick King
(74) *Attorney, Agent, or Firm* — Cooper & Dunham LLP

(57) ABSTRACT

An image forming apparatus is disclosed, including a carriage which moves and scans, the carriage being provided with a recording head which ejects liquid droplets; and a sheet-shaped receiving face member which forms a receiving face which receives non-contributing liquid droplets which do not contribute to image forming, the non-contributing liquid droplets being ejected from the recording head. The receiving face member is movably arranged, and the image forming apparatus further includes a drive unit which moves the receiving face member in conjunction with movement of the carriage.

8 Claims, 8 Drawing Sheets

IMAGE FORMING APPARATUS

TECHNICAL FIELD

The present invention generally relates to image forming apparatuses and specifically relates to image forming apparatuses which include recording heads which eject liquid droplets.

BACKGROUND ART

As an image forming device for a printer, a facsimile machine, a reproducing unit, a plotter, and a multifunctional unit having these functions, an inkjet recording device is known as a liquid ejection recording-type image forming device which uses a recording head which ejects ink droplets, for example. The liquid ejection recording-type image forming device, which ejects the ink droplets from the recording head to a sheet to be conveyed to perform image forming (recording, print, imaging, printing also used interchangeably), includes a serial-type image forming device which ejects liquid droplets while the recording head moves in a main scanning direction to perform image forming and a line-type image forming device with the use of a line-type head which ejects liquid droplets while the recording head does not move to perform image forming.

Herein, an "image forming device" represents a device which sets ink onto a medium such as paper, thread, fiber, cloth, leather, metal, plastic, glass, wood, ceramics, etc., to perform image forming, and "image forming" represents not only providing a medium with an image which has a meaning (e.g., character or graphics), but also providing a medium with an image which does not have a meaning such as a pattern, etc. (merely impacting the liquid droplet onto the medium). Moreover, "ink" is not limited to what is called ink, so that it is used to generally represent all types of liquids which can perform image forming, such as what is called recording liquid, fixing solution, liquid, resin, etc. Furthermore, the "sheet", a material of which is not limited to paper and which includes an OHP sheet, a cloth, etc., represents what the ink droplets are adhered to and is used to generally represent what includes a medium to be recorded on, a recording medium, recording paper, a recording sheet, etc. Moreover, an "image" is not limited to a planar one, so that it also includes an image provided to what is formed three-dimensionally, and also an image formed by three dimensionally shaping a solid itself.

Now, a liquid ejection-type image forming device includes a maintaining and restoring mechanism which includes a wiper member (also called a wiper blade, a wiping blade, a blade, etc.) which wipes off a nozzle face of a recording head for cleaning; and a cap which caps a nozzle face of the recording head in order to maintain ejection stability of a nozzle of the recording head, to prevent ink in the nozzle from drying and to prevent dust from mixing into the nozzle). A recovering operation is performed in which, for instance, after draining bodied-up ink from the nozzle into the cap, the device wipes off the nozzle face with the wiper member to form a nozzle meniscus and a non-contributing ejection operation is performed in which a liquid droplet which does not contribute to image forming is ejected from the recording head at a required timing.

A related-art non-contributing ejection receiving member for receiving non-contributing ejection droplets which are ejected in an non-contributing ejection operation is known, wherein a multi-porous sheet is arranged at a position which is in proximity to and which opposes a recording head and a waste liquid which is received at the multi-porous sheet is absorbed by an absorbing material (see Patent document 1).

PATENT DOCUMENT

Patent Document 1: JP2000-153621A

However, with the above-described non-contributing ejection receiving member which uses the multi-porous sheet, there is a problem that the liquid droplets (the waste liquid) which are received at the non-contributing ejection receiver accumulate to interfere with a nozzle face of the recording head, so that the nozzle face is contaminated.

DISCLOSURE OF THE INVENTION

In light of the problems as described above, an object of the present invention is to make it possible to receive non-contributing ejection droplets without contaminating a nozzle face of a recording head.

In order to solve the problems as described above, an image forming apparatus according to embodiments of the invention is provided. The image forming apparatus includes, a carriage which moves and scans, the carriage being provided with a recording head which ejects a liquid droplet; and a sheet-shaped receiving face member which forms a receiving face which receives a non-contributing liquid droplet which does not contribute to image forming, the non-contributing liquid droplet being ejected from the recording head, wherein the receiving face member is movably arranged, the image forming apparatus further including a drive unit which moves the receiving face member in conjunction with movement of the carriage.

Here, the apparatus may be arranged such that the receiving face member is movably wound onto one or more drive roller members and a follower roller member, and the drive unit includes a drive axle which is connected to the drive roller member, and a unit which transforms movement of the carriage to rotation of the drive axle in one direction.

Moreover, the apparatus may be arranged to further include two or more of the drive roller members, wherein the receiving face member is placed between and wound onto the two drive roller members.

Furthermore, the apparatus may be arranged such that the receiving face member is movably wound onto the drive roller member and the follower roller member and one or more rod-shaped supporting members.

Moreover, the apparatus may be arranged such that a surface portion which is in contact with the receiving face member of the supporting member is provided with a convex-shaped portion on a peripheral face, the convex-shaped portion being separated in a direction which is orthogonal to the receiving face member moving direction.

Furthermore, the apparatus may be arranged to further include two or more of the supporting members arranged on an upstream side in a receiving face member moving direction of a follower roller, wherein the receiving face member is wound in an S-shaped manner onto the two supporting members.

Moreover, the apparatus may be arranged such that the receiving face member and the members the receiving face member is wound onto are arranged to be detachably cartridged with respect to the apparatus body.

An image forming apparatus according to embodiments of the invention is arranged such that a receiving face member is movably arranged and a drive unit is included which moves the receiving face member in conjunction with movement of a carriage, making it possible to move a new receiving portion to a position at which a non-contributing ejection droplet may be received before accumulation of plural of the non-contributing ejection droplets occurs and to receive a non-contributing ejection droplet without staining the nozzle face of the recording head.

BRIEF DESCRIPTION OF THE DRAWINGS

FIG. 2 is an explanatory diagram in which FIG. 1 is viewed in an arrow A indicated direction;

BEST MODE FOR CARRYING OUT THE INVENTION

Figure 1:
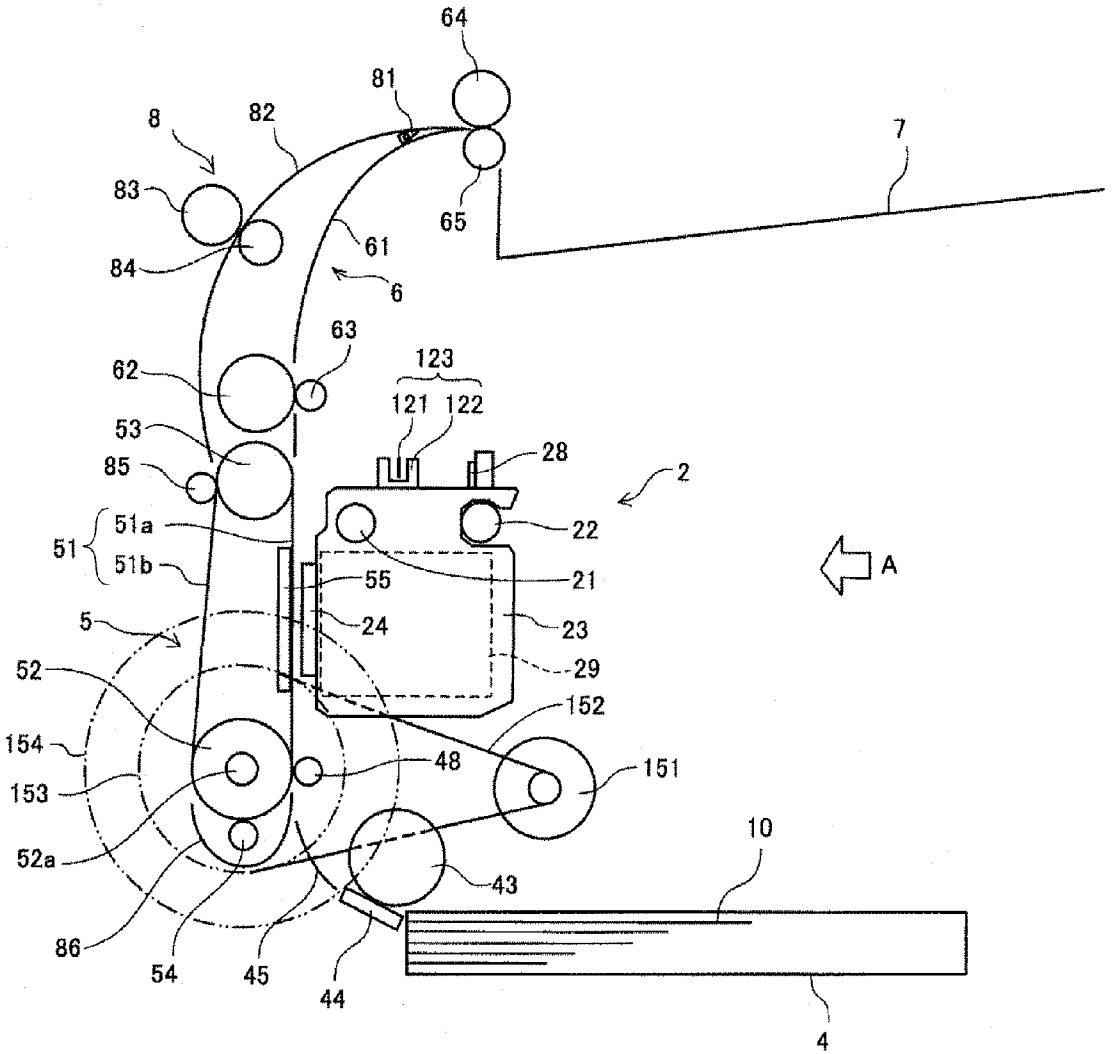
FIG. 1 is an explanatory diagram of a side face of a machinery section of an image forming device according to an embodiment of the present invention.
Figure 2:
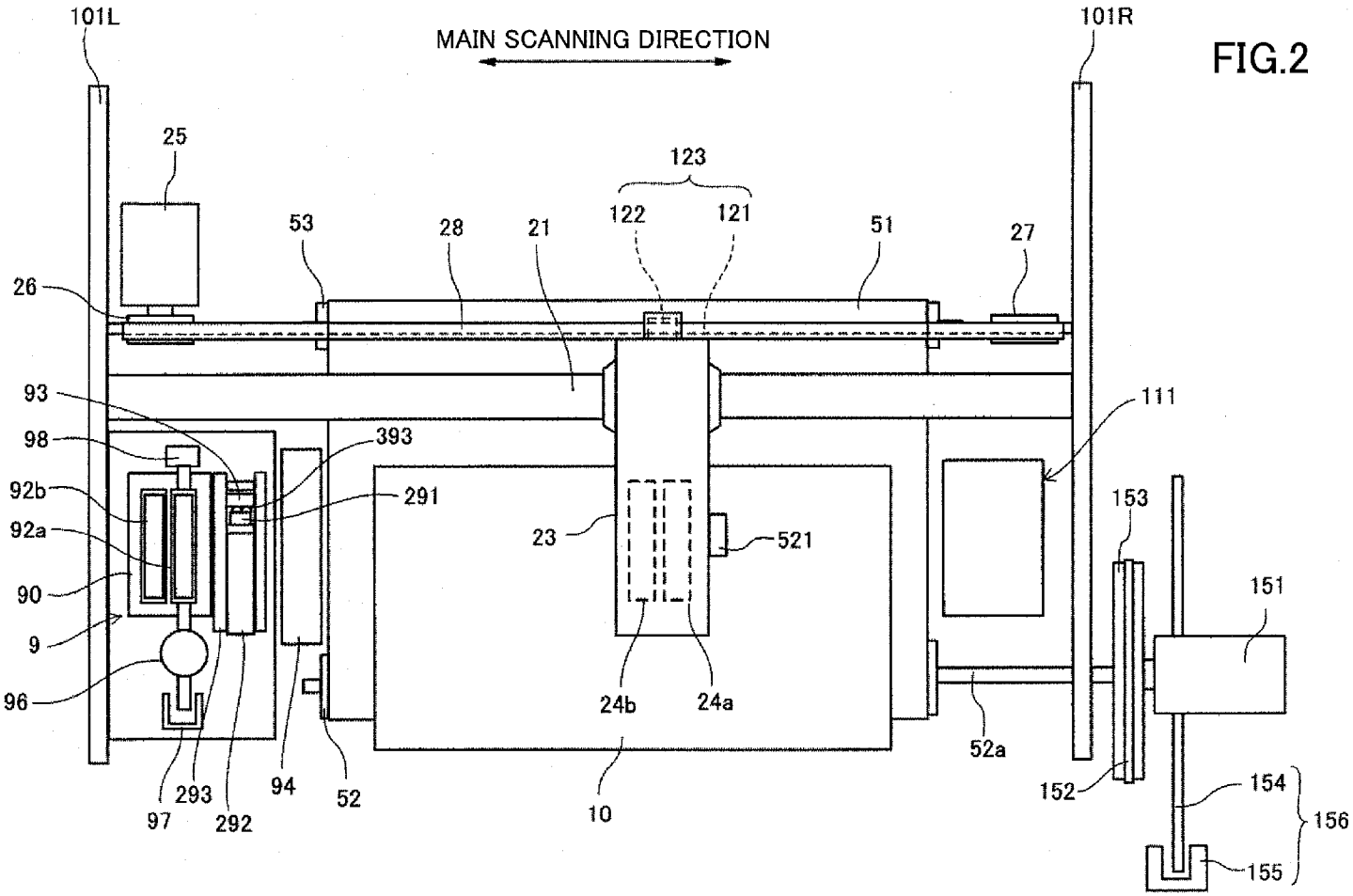

A description is given below with regard to embodiments of the present invention with reference to the drawings. First, an image forming device according to an embodiment of the present invention is explained with reference to FIGS. 1 and 2. FIG. 1 is an explanatory diagram of a side face of a machinery section of an image forming device, and FIG. 2 is an explanatory diagram in which FIG. 1 is viewed in an arrow A indicated direction.

The image forming device, which is a serial-type image forming device, includes, in a not-shown body thereof, an image forming section 2, a conveying machinery section 5, etc., and includes, on the lower side of the device body, a paper-supply tray (includes a paper-supply cassette; used to represent a paper-supply section) 4 on which the device can stack a sheet 10, which is a medium to be recorded on. The device takes in the sheet 10 supplied from the paper-supply tray 4, intermittently conveys the sheet 10 in a perpendicular direction (a direction along a vertical direction) by the conveying machinery 5, and at the same time, by the image forming section 2, horizontally ejects liquid droplets to record a required image thereon, after which it further conveys upward the sheet 10 on which the image is formed via a paper-discharge section 6 to discharge the sheet 10 onto a paper-discharge tray 7 which is provided on the upper side of the device body.

Moreover, when double face printing is conducted, after completing a single face (surface) printing, the sheet 10 is taken in from the paper-discharge section 6 into a reversing section 8, and is reversed while being conveyed in a reverse direction (downward direction) by the conveying machinery section 5 to again be sent into the conveying machinery 5 with the other face (a back face) as a face on which printing is possible, and, after the printing of the other face (the back face) is completed, the sheet 10 is discharged onto the paper-discharge tray 7.

Here, the image forming section 2 slidably holds, with a main guide member 21 and a sub guide member 22 which are laterally bridged across left and right side plates 101L and 101R, a carriage 23 on which is mounted a recording head 24, and that moves and scans, driven by a main-scanning motor 25 in a main-scanning direction via a timing belt 28 which is bridged across a drive pulley 26 and a follower pulley 27.

In the carriage 23 are installed recording heads 24*a* and 24*b* (called "recording heads 24" when not distinguishing therebetween) which include liquid ejecting heads for ejecting ink droplets of colors of yellow (Y), magenta (M), cyan (C), and black (K), with a nozzle sequence which includes multiple nozzles being aligned in a sub scanning direction which is orthogonal to the main scanning direction and a horizontal droplet ejecting direction. In other words, a horizontal ejecting scheme is adopted in which a recording head 24 is provided, a nozzle face on which nozzles which eject liquid droplets are vertically arranged and the liquid droplets are horizontally ejected.

Figure 3:
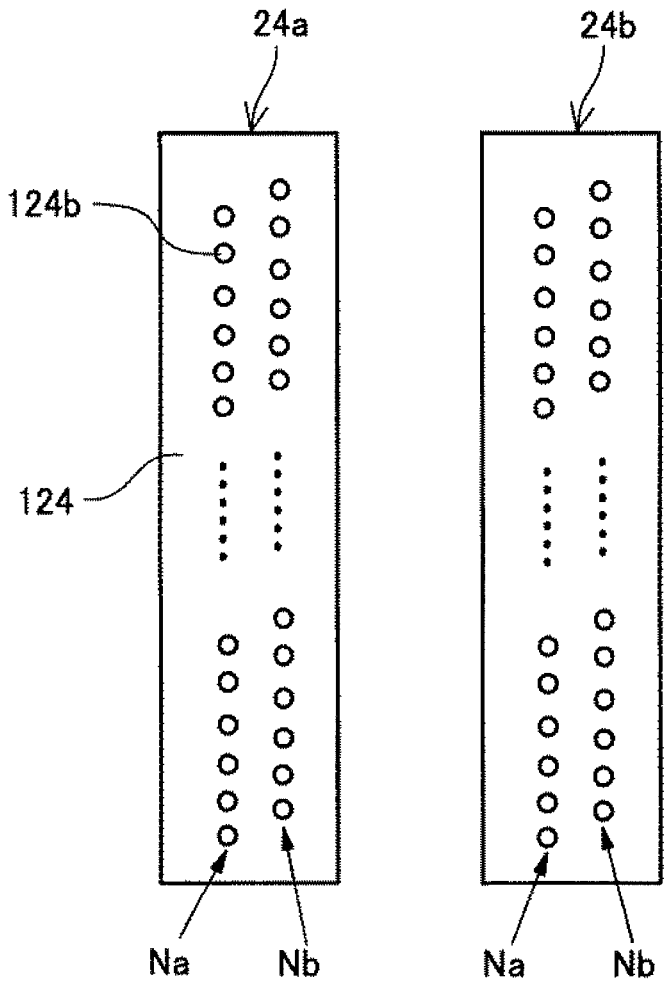
FIG. 3 is an explanatory diagram of a recording head.

As shown in FIG. 3, the recording head 24 has two nozzle sequences Na and Nb, on which nozzles 124*b*, each of which ejects multiple liquid droplets, are installed in a row, wherein one of the nozzle sequences Na of the recording head 24*a* ejects liquid droplets of yellow (Y), the other nozzle sequence Nb thereof ejects liquid droplets of magenta (M), one of the nozzle sequences Na of the recording head 24*b* ejects liquid droplets of black (K), and the other nozzle sequence Nb thereof ejects liquid droplets of cyan (C).

In a liquid ejecting head which makes up the recording head 24, as a pressure generating unit which generates pressure for ejecting the liquid droplets, a piezoelectric actuator such as a piezoelectric element, etc., a thermal actuator which utilizes phase change by liquid film boiling using a thermoelectric conversion element such as a heat element, etc., a shape-memory alloy actuator which uses a metal phase change by a temperature change, or an electrostatic actuator which uses electrostatic force, etc., may be used. Moreover, the carriage 23 may also be provided with a liquid ejecting head for ejecting a fixing solution which reacts with ink to increase fixability of the ink, etc.

Furthermore, while not shown, on the carriage 23 are mounted head tanks 29 for supplying ink of the colors in correspondence with the nozzle sequences Na and Nb of the recording heads 24, to which head tanks 29 ink colors are supplied from ink cartridges (main tanks) of the corresponding colors that are detachably installed in the device body.

Moreover, an encoder scale 121 which has formed thereon a predetermined pattern is stretched between the side plates 101L and 101R along the main-scanning direction of the carriage 23; on the carriage 23 is provided an encoder sensor 122 which includes a transmissive photo sensor which reads the pattern of the encoder scale 121, so that the encoder scale 121 and encoder sensor 122 make up a linear encoder (a main-scanning encoder) which senses movement of the carriage 23.

Furthermore, in a non-print area of one side of the scanning direction of the carriage 23, a maintenance and recovery mechanism 9 is arranged for maintaining and recovering a state of the nozzles 124*b* of the recording heads 24. This maintenance and recovery mechanism 9 holds a cap 92*b* and an absorbing cap 92*a* ("called "cap 92" when not distinguishing therebetween) for capping each nozzle face 124 of the recording head 24 (see FIG. 3) and a wiper member (a wiper blade) 93 which moves the nozzle face 124 in an arrow-indicated direction for wiping, and also includes a non-contributing ejection receiver 94 which receives non-contributing liquid droplets when conducting a non-contributing ejection in which liquid droplets which do not contribute to recording are ejected in order to discharge thickened ink. To the absorbing cap 92*a* is connected an absorbing pump 96 as an absorbing unit, which absorbing pump 96 is in communication with a waste liquid tank 97. Moreover, an atmospheric release valve 98 which can open and close is provided which opens, to atmosphere, an enclosed space which is formed when capping the nozzle face 124 of the recording head 24 with the absorbing cap 92*a*.

Moreover, in a non-printing region on another side of the carriage 23 in the main scanning direction is arranged a non-contributing ejection receiving face cartridge 111 which includes a receiving face member which receives non-contributing ejection droplets which are ejected from the recording head 24.

With a paper-supply roller (a crescent roller) 43 and a separation pad 44, sheets 10 of the paper-supply tray 4 are separated on a sheet by sheet basis, are supplied into the device body, are sent between a conveying belt 51 and a pressing roller 48 of the conveying machinery section 5, and held to the conveying belt for conveying.

The conveying machinery section 5 includes the endless-shaped conveying belt 51 which is bridged across a follower roller 53 and a conveying roller 52, which is a driving roller; a charging roller 54 for charging the conveying belt 51; a platen member 55 which maintains the planar characteristic of the conveying belt 51 at a portion opposing an image forming section 2, etc.

The conveying belt 51 circularly moves in the belt conveying direction (sub-scanning direction, sheet conveying direction) by the conveying roller 52 being rotationally driven via a timing belt 152 and a timing pulley 153 by a sub-scanning motor 151. Of the conveying belt 51, a region from the conveying roller 52 to the follower roller 53 that holds the sheets 10 in opposition to the image forming section 2 is called a forward conveying portion 51*a*, while a region from the follower roller 53 to the conveying roller 52 is called a backward conveying portion 51*b*.

Moreover, an encoder sensor 155 is provided which includes a transmissive photo sensor which detects a pattern formed on a code wheel 154 which is mounted on an axle 52*a* of the conveying roller 52, so that the code wheel 154 and the encoder sensor 155 make up a rotary encoder (a sub-scanning encoder) 156 which detects a moving position and a moving amount of the conveying belt 51.

The paper output section 6, in which a paper-output guide member 61, a paper-output conveying roller 62 and a spur 63, and a paper-output roller 64 and a spur 65 are arranged, outputs the sheet 10 on which an image is formed onto a paper-output tray 7 between the paper-output roller 64 and the spur 65.

Moreover, in order to reverse, with a switchback scheme, the front and back of the sheets 10, some of which are output to the paper-output tray 7, to send them between the conveying belt 51 and the pressing roller 48 again, a reversing section 8 includes a switching pawl 81 which switches between a paper-output channel and a reverse channel; a reversing guide member 82; a spur 84, which is a reversing roller and a reversing roller 83; a follower auxiliary roller 85, which opposes the follower roller 53; a reverse sending portion 51*b* of the conveying belt 51; a bypassing guide member 86 which guides the sheets 10 separated from the reverse sending portion 51*b* of the conveying belt 51 between the conveying belt 51 and the pressing roller 48, bypassing the charging roller 54, etc.

In the image forming device thus configured, the sheets 10 are supplied from the paper-supply tray 4 in a manner such that they are separated on a sheet by sheet basis, the sheets 10 are statically attracted to and held by the charged conveying belt 51 and are vertically conveyed by a circular movement of the conveying belt 51. Then, the recording head 24 is driven according to an image signal while moving the carriage 23 to eject ink droplets onto the sheet 10 at rest to record what amounts to one line, and recording for the following line is performed after the sheet 10 is conveyed for a predetermined amount, and the sheet 10 on which the recording has been completed is output to the paper-output tray 7.

Then, when maintaining and recovering the nozzles 124*b* of the recording head 24, maintenance and recovery operations are performed such as nozzle suctioning in which the carriage 23 is moved to a position which opposes the maintenance and recovery mechanism 9, which position is a home position, to cap the recording head 24 by an absorbing cap 92 to perform suctioning and discharge from the nozzles 124*b*, non-contributing ejections in which liquid droplets which do not contribute to image forming are ejected, etc., making it possible to perform image forming by stable liquid droplet ejection.

Moreover, when performing double-face printing, the above described operation is performed for printing a first face, and when a trailing edge of the sheet 10 passes through a reversing section branch (the switching pawl 81), the paper-output roller 64 is reversed and driven, so that the sheet 10 is switched back and guided to the reversing guide member 82 side, and conveyed between the reversing roller 83 and the spur 84, so that the sheet 10 is sent between the conveying auxiliary roller 85 and the backward conveying portion 51*b* of the conveying belt 51.

In this way, the sheet 10 is held on the conveying belt 51, conveyed by circular movement of the conveying belt 51, separated from the conveying belt 51 on the conveying roller 52 side to be guided by the bypassing guide member 86 (via a bypassing path), again sent toward the pressing roller 48 and the forward conveying portion 51*a* of the conveying belt 51 to be attracted by the conveying belt 51, and again held and conveyed to the image forming region of the recording head 24, so that a second face printing is performed, after which it is output to the paper-output tray 7.

Here, the charging roller 54 is arranged inside the bypassing path at the time of reversing (inside the bypassing guide member 86), so that the sheet 10 is attracted onto the conveying belt 51 which is always newly charged.

Figure 4:
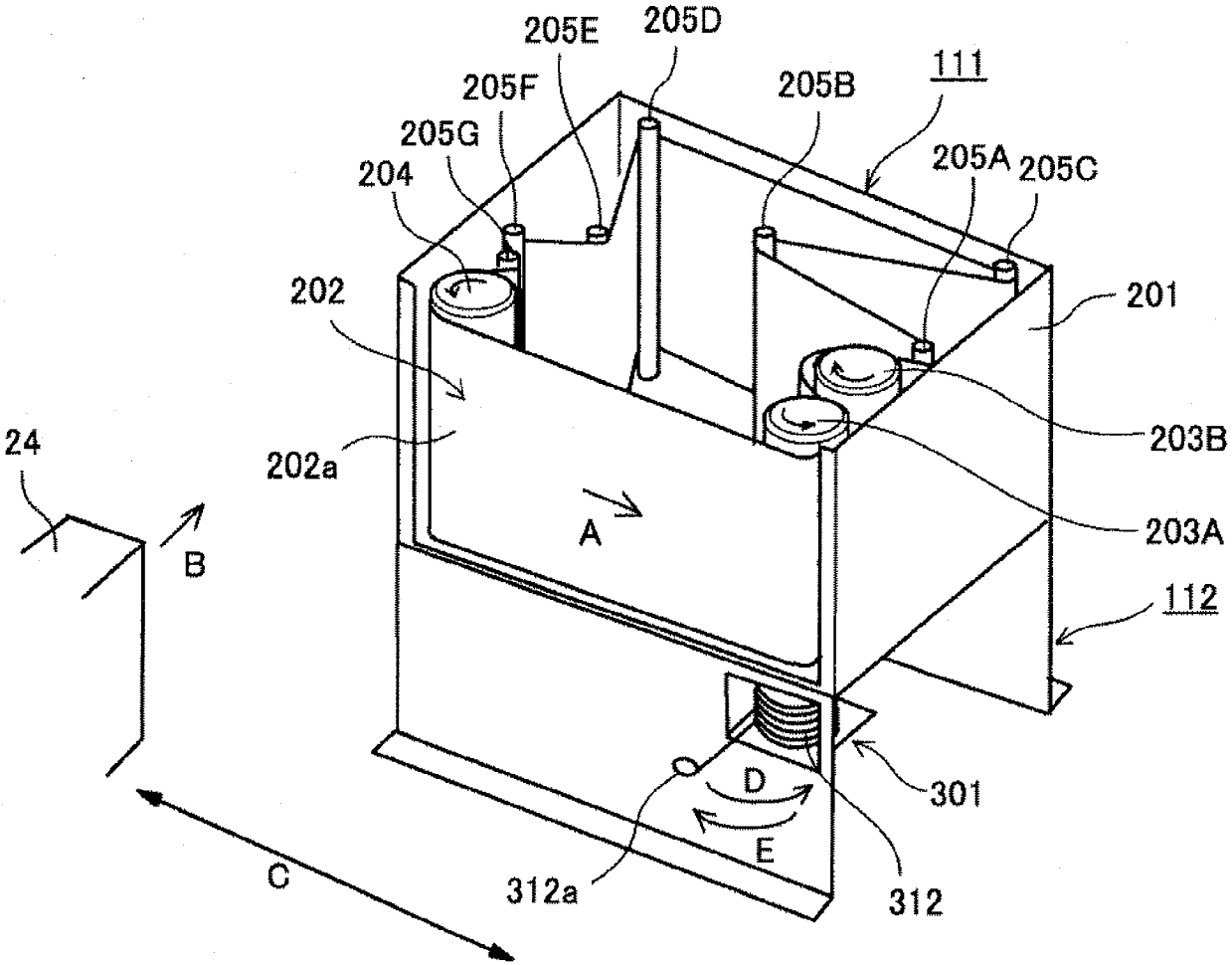
FIG. 4 is a perspective explanatory diagram of a non-contributing ejection receiving face cartridge and a cartridge installing section.

Next, a non-contributing ejection receiving face cartridge is described with reference to FIG. 4. FIG. 4 is a perspective explanatory diagram of the above-described cartridge and a cartridge installing section. Here, the recording head 24, which is shown to be away from a receiving face of a cartridge for the purpose of explanations, is actually in proximity.

A non-contributing ejection receiving face cartridge 111, which includes, within a cartridge case 201, a sheet-shaped receiving face member 202 which forms a receiving face 202*a* which receives non-contributing ejection droplets, is detachably installed in a cartridge installing section 112 which includes a drive unit 301 which moves the receiving face member 202.

Here, within the cartridge case 201 are arranged a first drive roller member 203A, to which drive power is transmitted from the drive unit 301 of the cartridge installing section 112 for rotating; a second drive roller member 203B, to which drive power is transmitted from the drive roller member 203A for rotating; a follower roller member 204 which is rotatably provided with a separation in a main-scanning direction C relative to the first drive roller member 203A; and multiple rod-shaped supporting members (below called "supporting rod members") 205A-205G, wherein the receiving face member 202 is arranged such that it is circularly movable in an arrow A indicated direction, being wound across the first and second drive roller members 203A and 203B, supporting rod members 205A to 205G, and the follower roller member 204.

While the receiving face member 202 is formed with an absorbent material (e.g., a web), it may also be formed with a multi-porous sheet or a water-repellant material.

When the carriage 23 moves from a print region to a position which opposes the receiving face member 202 for a non-contributing ejection operation, the drive unit 301 of the cartridge installing unit 112, which is described below and which is detachably connected to the first drive roller member 203A of the non-contributing receiving face cartridge 111, transforms movement in the main-scanning direction to rotation in one direction to rotate the first drive roller member 203A of the non-contributing ejection receiving face cartridge 111.

According to the above-described configuration, when the carriage 23 is moved to a position opposing the receiving face member 202 in order to perform non-contributing ejection from the recording head 24, the first drive roller 203A rotates, so that the receiving face member 202 moves in an arrow A indicated direction, at which time, a non-contributing ejection droplet is ejected in an arrow B indicated direction toward the receiving face 202*a* of the receiving face member 202 from the recording head 24. In this way, when the carriage 23 is moved to a position opposing the receiving face member 202 for the next non-contributing ejection operation, the receiving face member 202 similarly moves in an arrow A indicated direction, so that non-contributing ejection is performed with a new portion of the receiving face 202*a* opposing the recording head 24 and accumulation of the non-contributing ejection droplets at the receiving face 202*a* is reduced.

Figure 5:
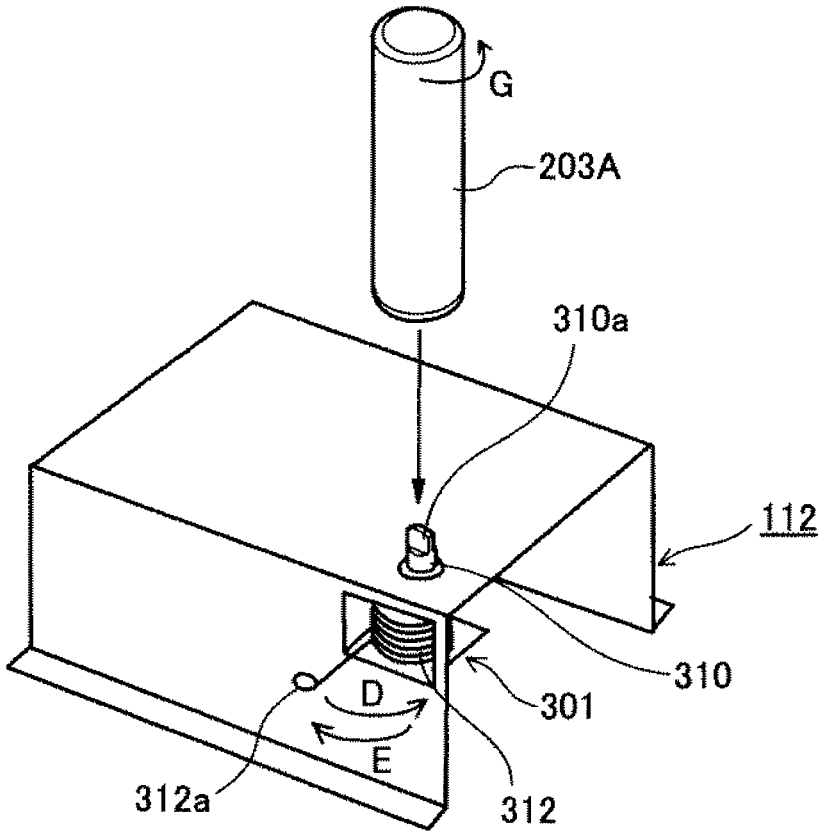
FIG. 5 is a perspective explanatory diagram with the cartridge installing section and a first drive roller member being separated.
Figure 6A:
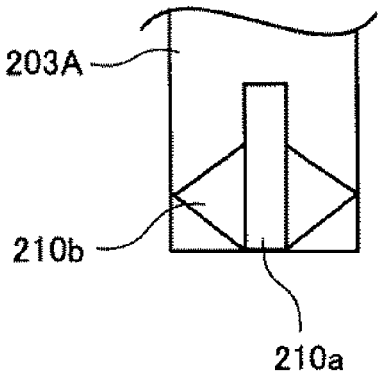
FIGS. 6A and 6B are explanatory diagrams which serve to explain a connecting portion of the first drive roller member.
Figure 6B:
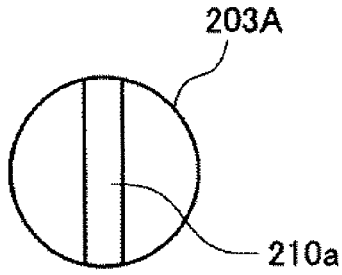

Next, a connecting structure between the drive unit 301 of the cartridge installing unit 112 and the non-contributing ejection receiving face cartridge 111 is described with reference to FIGS. 5, 6A, and 6B. FIG. 5 is a perspective explanatory diagram with a cartridge installing section and the first drive roller member 203A being separated and FIGS. 6A and 6B are explanatory diagrams which serve to explain a connecting portion of the first drive roller member 203A.

The drive unit 301 has a drive axle 310 which rotates in one direction with movement of the carriage 23, a connecting section 310*a* of the drive axle 310 being formed as a minus-shaped convex section. A groove section 210*a* which is detachably fitted into the connecting section 310*a* of the drive axle 310 is formed at the first drive roller member 203A. Then, on both sides of the groove section 210*a* is provided, in a bilaterally symmetrical manner, a tapering section 210*b* in the moving direction (rotating direction) of the receiving face 202*a*, so that, even when the first drive roller member 203A is off from a fitting position of the drive axle 310, it makes contact with the drive axle 310, so that the first drive roller member 203A rotates in an arrow G indicated direction and the connecting section 310*a* of the drive axle 310 fits into the groove section 210*a* of the first roller member 230A.

In this way, even when the non-contributing receiving face cartridge 111 is not rotated, the first drive roller member 203A and the drive axle 310*a* may be connected.

Figure 7:
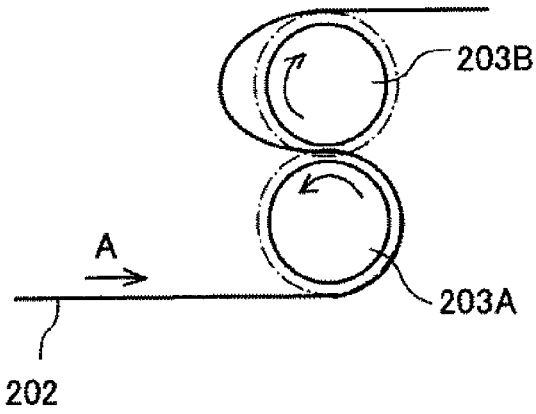
FIG. 7 is a plan explanatory diagram in the vicinity of a first drive roller and a second drive roller of the same cartridge.

Next, configurations of the first drive roller member 203A and the second drive roller member 203B and winding thereto of the receiving face member 202 are described with reference to FIG. 7. FIG. 7 is a plan explanatory diagram in the vicinity of the first drive roller member 203A and the second drive roller member 203B.

The receiving face member 202 is placed between the first drive roller member 203A and the second drive roller member 203B, each of which first drive roller member 203A and second drive roller member 203B includes a toothed pulley, to wind around a peripheral face of the first drive roller member 203A and the second drive roller member 203B in an S-shaped manner.

In this way, even when a non-contributing ejection droplet adheres to the receiving face 202*a* of the receiving face member 202, the receiving member 202 may be moved without the non-contributing rejection droplet sticking to the peripheral face of the first and second drive roller members 203A and 203B.

Figure 8:
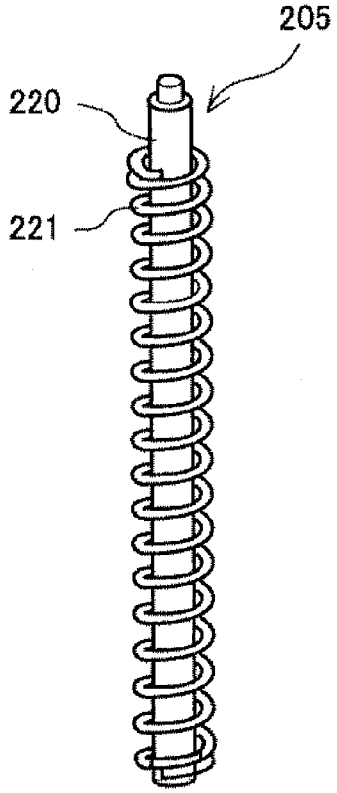
FIG. 8 is a perspective explanatory diagram which shows a shape by appearance of a supporting rod member in FIG. 4.

Next, the supporting rod member 205 is described with reference to FIG. 8. FIG. 8 is a perspective explanatory diagram which shows a shape by appearance of the supporting rod members 205A-G in FIG. 4.

The supporting rod member 205 is arranged such that a spiral-shaped member 221 such as a spring, etc., is fitted to a peripheral face of the rod member 220, so that a surface portion which is in contact with the receiving face member 202 is arranged such that a convex-shaped portion which is separated in a direction orthogonal to a receiving face member moving direction is provided on a peripheral face.

In this way, an area of contact between the supporting rod member 205 and the receiving face member 202 decreases, and moving load of the receiving face member 202 decreases. Moreover, for the supporting rod member 205, to which an outer peripheral face the receiving face 202*a* on which non-contributing ejection droplets of the receiving face member 202 adhere is in contact, the receiving face 202*a* is prevented from sticking to the outer peripheral face. In this way, a smooth movement of the receiving face member 202 may be secured.

Figure 9:
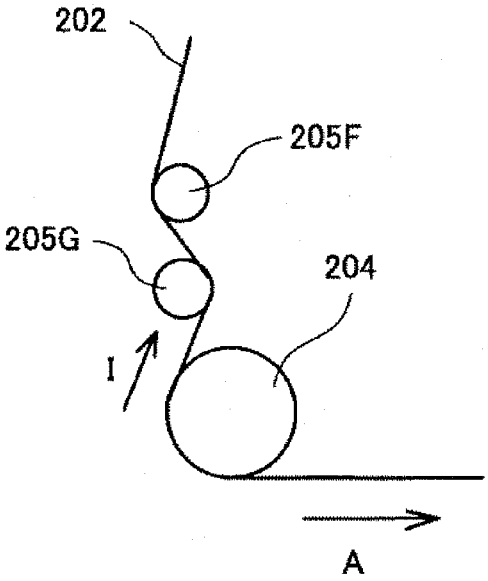
FIG. 9 is a feature plan explanatory diagram for the vicinity of a follower roller member.

Next, the tension feature on the follower roller member 204 side is described with reference to FIG. 9. FIG. 9 is a feature plan explanatory diagram in the vicinity of the follower roller member.

Two of the supporting rod members 205F and 205G are provided on the upstream side of the follower roller member 204 in the receiving face member moving direction, and the receiving face member 202 is wound in an S-shaped manner from the peripheral face of the supporting rod member 205F to the peripheral face of the supporting rod member 205G and is wound from the supporting rod member 205G to the peripheral face of the follower roller member 204. Here, tension is provided which presses the receiving face member 202 in an arrow I indicated direction by the supporting rod member 205G which is arranged between the supporting rod member 205F and the follower roller member 204, so it is ensured that the receiving face member 202 follows the peripheral face of the follower roller member 204.

In this way, the receiving face member 202 floats from the peripheral face of the follower roller member 204 to prevent it from interfering with the nozzle face 124 of the recording head 24.

Figure 10:
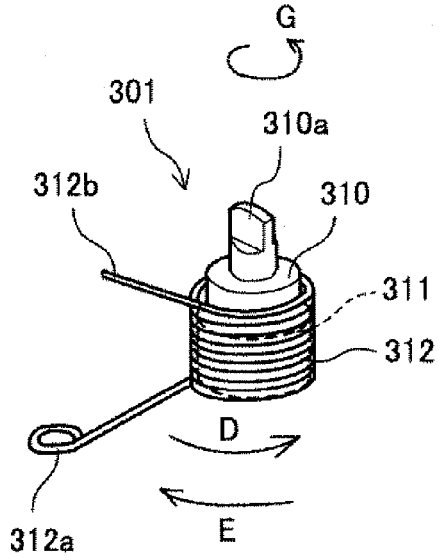
FIG. 10 is a perspective explanatory diagram of a drive unit.
Figure 11:
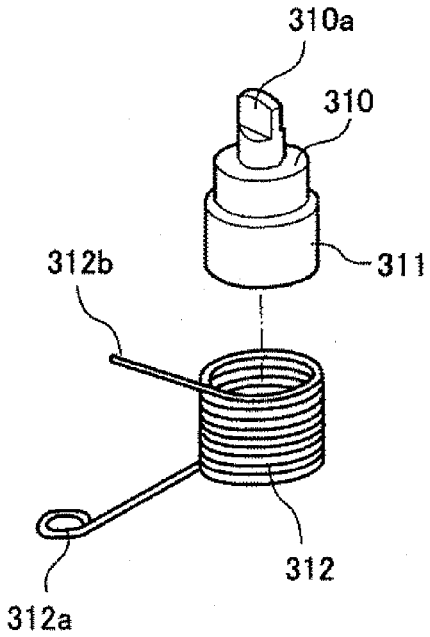
FIG. 11 is an exploded perspective explanatory diagram of the drive unit.

Now, the drive unit 301 is described with reference to FIGS. 10 and 11. FIG. 10 is a perspective explanatory diagram of the drive unit 301, while FIG. 11 is an exploded perspective explanatory diagram of the drive unit 301.

The drive unit 301 includes a rotating axle member 311 which has integrally formed a drive axle 310 and which has a diameter greater than that of the drive axle 310, and a coil spring 312 which is fitted to the outer peripheral face of the axle member 311.

The rotating axle member 311 is rotatably arranged. To the coil spring 312 is provided a pressing piece 312*a* which is pressed when the carriage 33 moves to a non-contributing ejection position (moves to a position opposing the receiving face member 202) and a nipping piece 312*b* which is nipped to a fixing section.

When the pressing piece 312*a* of this coil spring 312 is pressed in an arrow D indicated direction, the coil spring 312 which is tightened to the outer peripheral face of the rotating axle member 311 is twisted, and a further pressing of the pressing piece 312*a* by the carriage 23 rotates the rotating axle member 311 in the arrow D indicated direction. Moreover, the carriage 23 evacuates a non-contributing ejection position (moves to the print region side), so that the pressing piece 312*a* of the coil spring 312 is restored and moves in an arrow E indicated direction since a gap is provided between the coil spring 312 and the drive axle 310. A one-way clutch (not shown) is provided within the rotating axle member (and the drive axle), so that the rotating axle member 311 does not rotate when the carriage 23 moves to the print region side.

In this way, movement of the carriage 33 is transformed to movement of the rotating axle member 311 in one direction, and the drive axle 310, which is integral with the rotating axle member 311 also rotates in one direction, or only in a direction in which the receiving face member 202 is moved in an arrow A indicated direction in FIG. 3.

In this way, the receiving face member 202 is arranged such that it has a drive unit which moves the receiving face member 202 in conjunction with movement of the carriage 23 and such that it is movably arranged, making it possible to move a new receiving portion to a position at which non-contributing ejection droplets may be received before accumulation of the non-contributing ejection droplets occurs and to receive non-contributing ejection droplets without staining the nozzle face 124 of the recording head 24.

Moreover, the receiving face member 202, the first and second drive roller members 203A, 203B, the follower roller member 204, and multiple of the supporting rod members 205 are arranged in the above-described cartridge case 201 to be cartridged as a non-contributing ejection receiving face cartridge 111, and detachably install it in the cartridge installing section 112 of the device body, making it possible to easily replace the receiving face member 202.

In the above-described embodiment, while an example is described of conveying sheets in a direction (perpendicular direction) along a vertical direction and horizontally ejecting liquid droplets, the present invention may similarly be applied to a configuration of conveying sheets in a direction which is slanted relative to a direction (perpendicular direction) along a vertical direction and ejecting liquid droplets in a direction which is slanted relative to a horizontal direction. Moreover, the present invention may similarly be applied to a configuration of conveying sheets in a direction (horizontal direction) along the horizontal direction and ejecting droplets in a vertical direction and to a configuration of conveying sheets in a direction which is slanted relative to a direction (horizontal direction) along the horizontal direction and ejecting droplets in a direction which is slanted relative to the vertical direction.

The present application is based on Japanese Priority Application No. 2010-292132 filed on Dec. 28, 2010, the entire contents of which are hereby incorporated by reference.

The invention claimed is:

1. An image forming apparatus, comprising:

a carriage which moves and scans in a moving direction perpendicular to a sheet conveying direction, the carriage being provided with a recording head which ejects a liquid droplet through a nozzle of the recording head;

a sheet-shaped receiving face member which forms a receiving face which receives a non-contributing liquid droplet which does not contribute to image forming, the non-contributing liquid droplet being ejected from the nozzle to the receiving face member while the receiving face member and a nozzle face of the recording head are separated by a space therebetween, the receiving face member being arranged movably in the moving direction of the carriage; and a drive unit which moves the receiving face member in a receiving face member moving direction in conjunction with movement of the carriage, wherein the drive unit includes a drive axle, a rotating axle member integrally formed and rotatably arranged on the drive axle and having a diameter greater than that of the drive axle, and a coil spring fitted to an outer peripheral face of the rotating axle member, the coil spring has a pressing piece at one end of the coil spring, the pressing piece is configured and disposed to be pressed when the carriage moves to a non-contributing ejection position opposing the receiving face member, when the pressing piece of the coil spring is pressed in a pressing direction, the coil spring is twisted to tighten the coil spring around the outer peripheral face of the rotating axle member, and a further pressing of the pressing piece by the carriage, after the coil spring is tightened around the outer peripheral face of the rotating axle member, rotates the rotating axle member in the pressing direction, and when the carriage evacuates the non-contributing ejection position to move to the print region side, the pressing piece of the coil spring is released and moves in a release direction to provide a gap between the coil spring and the drive axle.

2. The image forming apparatus as claimed in claim 1, wherein the receiving face member is movably wound to one or more drive roller members and a follower roller member, and the drive axle is connected to the drive roller member.

3. The image forming apparatus as claimed in claim 2, further comprising two or more of the drive roller members, wherein the receiving face member is placed between and wound onto the two drive roller members.

4. The image forming apparatus as claimed in claim 2, wherein the receiving face member is movably wound onto the drive roller member and the follower roller member and one or more rod-shaped supporting members.

5. The image forming apparatus as claimed in claim 4, wherein the supporting member includes a rod-shaped portion and a convex-shaped portion provided on a peripheral face of the rod-shaped portion, the convex-shaped portion being separated in a direction which is orthogonal to the receiving face member moving direction.

6. The image forming apparatus as claimed in claim 4, further comprising:

two or more of the supporting members arranged on an upstream side in the moving direction of the receiving face member, wherein the receiving face member is wound in an S-shaped manner to the two supporting members.

7. The image forming apparatus as claimed in claim 2 further comprising an apparatus body, wherein the receiving face member and the drive roller members onto which the receiving face member is wound are arranged in a cartridge that is detachable from the apparatus body.

8. The image forming apparatus as claimed in claim 1, wherein the receiving face member is disposed in a non-printing region, and in a non-contributing ejection operation, the carriage moves the recording head to a position opposing the receiving face member and the recording head, when moved by the carriage to the position opposing the receiving face member, ejects the non-contributing liquid droplet from the nozzle to the receiving face member while the receiving face member and the nozzle face of the recording head are separated by a space therebetween.

* * * * *